US010245746B2

(12) United States Patent
Smith

(10) Patent No.: US 10,245,746 B2
(45) Date of Patent: Apr. 2, 2019

(54) STOCK GUIDE ASSEMBLY

(71) Applicant: Darrin E. Smith, Innisfil (CA)

(72) Inventor: Darrin E. Smith, Innisfil (CA)

(73) Assignee: JessEm Products Limited (CA)

( * ) Notice: Subject to any disclaimer, the term of this patent is extended or adjusted under 35 U.S.C. 154(b) by 47 days.

(21) Appl. No.: 15/357,508

(22) Filed: Nov. 21, 2016

(65) Prior Publication Data

US 2017/0066154 A1 Mar. 9, 2017

Related U.S. Application Data

(63) Continuation of application No. 14/546,810, filed on Nov. 18, 2014.

(51) Int. Cl.

| | |
|---|---|
| ***B27B 27/00*** | (2006.01) |
| ***B27B 27/02*** | (2006.01) |
| ***B27B 25/02*** | (2006.01) |
| ***B27B 25/06*** | (2006.01) |

(52) U.S. Cl.

CPC ..... *B27B 27/02* (2013.01); *B27B 25/02* (2013.01); *B27B 25/06* (2013.01)

(58) Field of Classification Search

CPC ..... B27B 27/02; B27B 25/06; B27B 25/02; B27B 25/00

See application file for complete search history.

(56) References Cited

U.S. PATENT DOCUMENTS

| | | | | |
|---|---|---|---|---|
| 2,817,376 A | | 12/1957 | Johannsen | |
| 3,221,583 A | | 12/1965 | Nichols et al. | |
| 3,738,403 A | | 6/1973 | Schwoch et al. | |
| 4,048,883 A | | 9/1977 | Lecrone | |
| 4,212,214 A | | 7/1980 | Bippus | |
| 4,469,318 A | * | 9/1984 | Slavic | B23Q 3/002 144/250.15 |
| 4,476,757 A | | 10/1984 | Morris | |
| 4,976,298 A | * | 12/1990 | Gibson | B27B 25/02 144/247 |
| 5,000,237 A | | 3/1991 | Berkeley et al. | |
| 5,058,474 A | * | 10/1991 | Herrera | B27B 25/02 144/253.1 |

(Continued)

OTHER PUBLICATIONS

International Search Report and Written Opinion for Application No. PCT/CA2014/050491, dated Jul. 22, 2014, 7 pages.

*Primary Examiner* — Jonathan G Riley

(74) *Attorney, Agent, or Firm* — Stinson Leonard Street LLP

(57) ABSTRACT

A stock guide assembly guides movement of stock along a work table. The assembly includes a base and a roller operatively connected to the base to engage stock and hold it against the work table. In some embodiments, a biasing member yieldably biases the roller to urge the stock toward the work table and accommodate changes in thickness of the stock. The roller can be mounted at a skew angle to urge the stock toward a fence of the work table. The assembly can include a shaft movable with respect to the base for translationally adjusting the distance of the roller from the base and rotatably adjusting the distance between the roller and the work table. The roller can be rotatably mounted to the end of an arm oriented relative the work table so stock kickback drives the arm to pivot and drive the roller toward the work surface.

16 Claims, 13 Drawing Sheets

(56) References Cited

U.S. PATENT DOCUMENTS

| | | | | |
|---|---|---|---|---|
| 5,148,846 | A * | 9/1992 | Van Gelder | B27B 25/02 144/250.13 |
| 5,546,670 | A | 8/1996 | Chiang | |
| 5,881,623 | A | 3/1999 | Otani et al. | |
| 6,568,441 | B2 * | 5/2003 | Jones | B23Q 3/002 144/250.15 |
| 6,619,347 | B2 | 9/2003 | Jukoff et al. | |
| 6,718,857 | B2 | 4/2004 | Kimmel et al. | |
| 6,968,766 | B2 | 11/2005 | Kimmel et al. | |
| 7,017,464 | B2 | 3/2006 | Coderre | |
| 7,140,286 | B2 | 11/2006 | Schwartz | |
| 7,299,840 | B1 | 11/2007 | Moschelli | |
| 7,341,081 | B1 * | 3/2008 | Villiger | B27B 25/02 144/253.1 |
| 7,882,866 | B2 | 2/2011 | Burrows | |
| 7,942,174 | B2 | 5/2011 | Kozina et al. | |
| 8,371,198 | B2 * | 2/2013 | Babine | B27B 25/02 83/441.1 |
| 8,523,923 | B2 * | 9/2013 | Thomke | A61B 17/60 24/335 |
| 2002/0144752 | A1 | 10/2002 | Jones | |
| 2002/0162439 | A1 | 11/2002 | Fontaine | |
| 2010/0307302 | A1 | 12/2010 | Smith | |
| 2011/0214541 | A1 * | 9/2011 | Rybka | B26D 1/00 83/13 |
| 2012/0118120 | A1 * | 5/2012 | Niichel | B27G 19/00 83/451 |
| 2014/0041494 | A1 | 2/2014 | Kelly et al. | |

* cited by examiner

STOCK GUIDE ASSEMBLY

FIELD OF THE INVENTION

Aspects of the present invention relate generally to cutting apparatuses and accessories and more particularly to stock guide assemblies.

BACKGROUND OF THE INVENTION

A stock guide is an accessory (e.g., a featherboard) used with a work table such as a table saw or router table to guide a piece of stock along the table as the stock is cut by a cutting implement. The featherboard opposes forces generated by the cutting implement tending to push the stock away from the cutting implement as the stock is moved past the cutting implement. Conventional featherboards are mounted on the work table and adjusted to a desired position to accommodate the size of the stock to be cut. However, there exists a need for a stock guide having improved guiding capabilities.

SUMMARY OF THE INVENTION

In one aspect, a stock guide assembly for use with a work table guides movement of stock along a work surface of the work table in a feed direction. The stock guide assembly comprises a base configured for mounting on the work table to secure the stock guide assembly thereto. A roller is operatively connected to the base at a skew angle for rotation relative to the base about a roller axis oriented at a transverse, non-perpendicular angle relative the feed direction and for movement in directions generally transverse to the roller axis. The roller is disposed relative to the base so that when the base is mounted on the work table the roller is positioned to engage stock passing by the base to hold the stock against the work table. A biasing member is operatively connected to the base and to the roller for yieldably biasing the roller relative to the base so that said transverse movement of the roller is biased in a direction toward the work surface when the base is mounted on the work table, thereby allowing the roller to resiliently move relative to the work surface for accommodating changes in thickness of the stock.

In another aspect, a stock guide assembly for use with a work table comprising a cutting element and a fence securable to the work table at a spaced apart dimension from the cutting element guides movement of stock along a work surface of the work table in a feed direction. The stock guide assembly comprises a base configured for mounting on the work table to secure the stock guide assembly thereto. A roller is disposed relative to the base so that when the base is mounted on the work table the roller is positioned to engage stock passing by the base to hold the stock against the work table. A shaft is operatively connected to the roller and connected to the base for selective movement along a longitudinal axis of the shaft with respect to the base and for selective rotation about the longitudinal axis of the shaft with respect to the base. The shaft is selectively movable with respect to the base along the longitudinal axis of the shaft for translationally adjusting the distance of the roller from the base, and the shaft is selectively rotatable with respect to the base about the longitudinal axis of the shaft for rotatably adjusting a distance between the roller and the work surface of the work table when the stock guide assembly is on the work table.

In still another aspect, a stock guide assembly for use with a work table comprising a cutting element and a fence securable to the work table at a spaced apart dimension from the cutting element guides movement of stock along a work surface of the work table in a feed direction. The stock guide assembly comprises a base configured for mounting on the work table to secure the stock guide assembly thereto. A roller is disposed relative to the base so that when the base is mounted on the work table the roller is positioned to engage stock passing by the base to hold the stock against the work table. An arm is operatively connected to the base and mounts the roller for rotation with respect to the arm and the base at an end of the arm. The arm is oriented relative the work surface when the base is mounted on the work table so that movement of the stock engaged with the roller in a kickback direction opposite the feed direction drives the arm to pivot in a direction that drives the roller toward the work surface.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
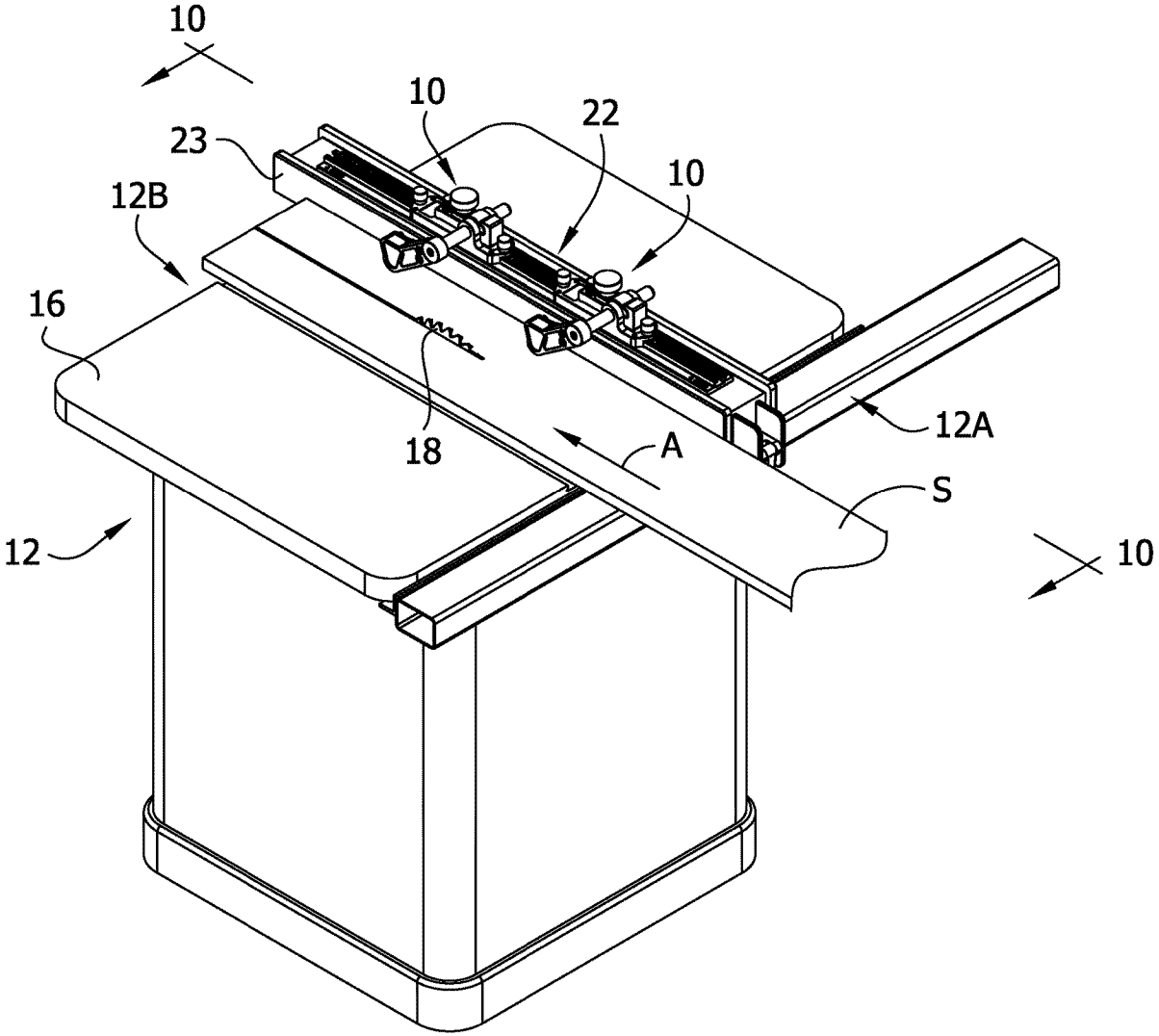
FIG. 1 is a perspective of a pair of stock guide assemblies attached to a work table.

Referring to FIG. 1, each of a pair of stock guide assemblies is generally indicated at reference number 10. Each stock guide assembly 10 is adapted for attachment to a work table 12. In the illustrated embodiment, one of the stock guide assemblies 10 is attached to the work table 12 adjacent an infeed end 12A of the work table and the other is attached adjacent an outfeed end 12B of the work table. The two stock guide assemblies 10 are identical in the illustrated embodiment, except for their location relative the ends 12A, 12B of the work table 12, but may have different constructions. FIG. 1 depicts the work table 12 as a table saw including a work surface 16 and a saw blade 18, which extends upward through an opening (not shown) in the table. The saw blade 18 is operatively connected to a motor (not shown) that rotates the saw blade about a cutting axis.

A fence 22 that is partially securable to the work table 12 is positioned on the work surface 16 at a laterally spaced apart location from the saw blade 18. In the illustrated embodiment, the fence 22 is secured to the table saw 12 at the infeed end 12A but is not secured to the table saw at the outfeed end 12B. As a result, the fence 22 can lift away from the work surface 16 adjacent the outfeed end 12B if an upward force is applied on the fence relative the work table 12. The stock guide assemblies 10 and fence 22 are adapted to guide a workpiece or piece of stock S (e.g., a piece of wood) past the saw blade 18 as the stock is moved across the work surface 16 in a feed direction A from the infeed end 12A to the outfeed end 12B of the work table 12. The fence 22 has a generally planar side 23 adjacent the saw blade 18 positioned in a plane parallel to the feed direction A. The fence 22 is positioned so that the stock S has the proper location relative to the saw blade 18 to make the desired cut in the stock. The stock guide assembly 10 can be used with other work tables (e.g., router tables) with other types of cutting elements without departing from the scope of the invention. Moreover, the fence 22 may be considered part of the stock guide assembly. By way of nonlimiting example, the fence may form part or all of the stock guide assembly base (not shown).

Referring to FIGS. 2-5, the stock guide assembly 10 has a base 30, a roller 36, and a connector assembly 34 (broadly a "connector") connecting the roller to the base. The base 30 is configured for mounting on the work table 12 to secure the stock guide assembly 10 thereto (FIG. 1). The connector assembly 34 operatively connects the roller 36 to the base 30 for rotation relative to the base about a roller axis RA. The roller 36 is also configured for movement relative to the base 30 in directions generally transverse to the roller axis RA. In the illustrated embodiment, the connector assembly 34 includes a shaft 38. The shaft 38 connects the base 30 to a roller arm 80 of the connector assembly 34, which mounts the roller 36. Other types of connector assemblies can also be used without departing from the scope of the invention. An inward end of the shaft 38 is configured to be secured to the base 30, and a free end of the shaft is secured to the roller arm 80. With the roller 36 secured to the roller arm 80, the roller arm secured to the shaft 38, and the shaft secured to the base 30, the roller is disposed relative the base so that when the base is mounted on the work table 12 (FIG. 1) the roller is positioned to engage stock S passing by the base to hold the stock against the surface 16 of the work table.

Figure 8:
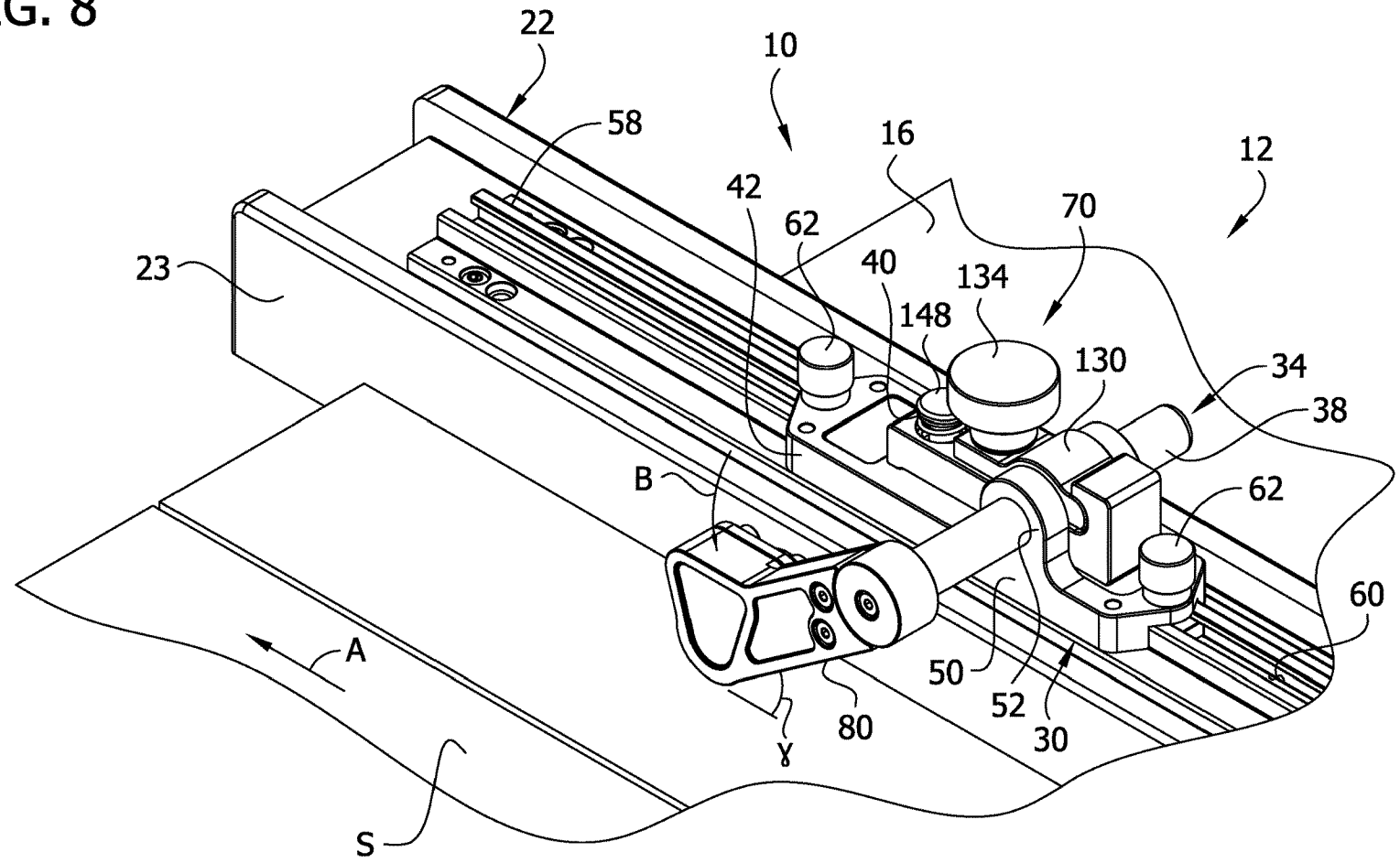
FIG. 8 is a fragmentary perspective of one of the stock guide assemblies attached to the work table.

A biasing member, in the form of a spring 40, is operatively connected to the base 30 and to the roller 36 for yieldably biasing the roller relative to the base so that the transverse movements of the roller are biased in a biasing direction (indicated at arrow B (FIG. 4)). Though the illustrated embodiment uses a compression spring 40, other types of biasing members can be used to yieldably bias a roller relative a base in a biasing direction without departing from the scope of the invention. As shown in FIG. 8, when the base 30 is mounted on the work table 12, the spring 40 yieldably biases the roller 36 in a biasing direction B that is toward the work surface 16 of the work table 12. As stock S moves along the work surface 16 in the feed direction A, the roller 36 moves in transverse directions (relative the roller axis RA) to accommodate changes in thickness of the stock S, and the spring 40 biases the roller toward the work surface to securely engage the stock.

Figure 5:
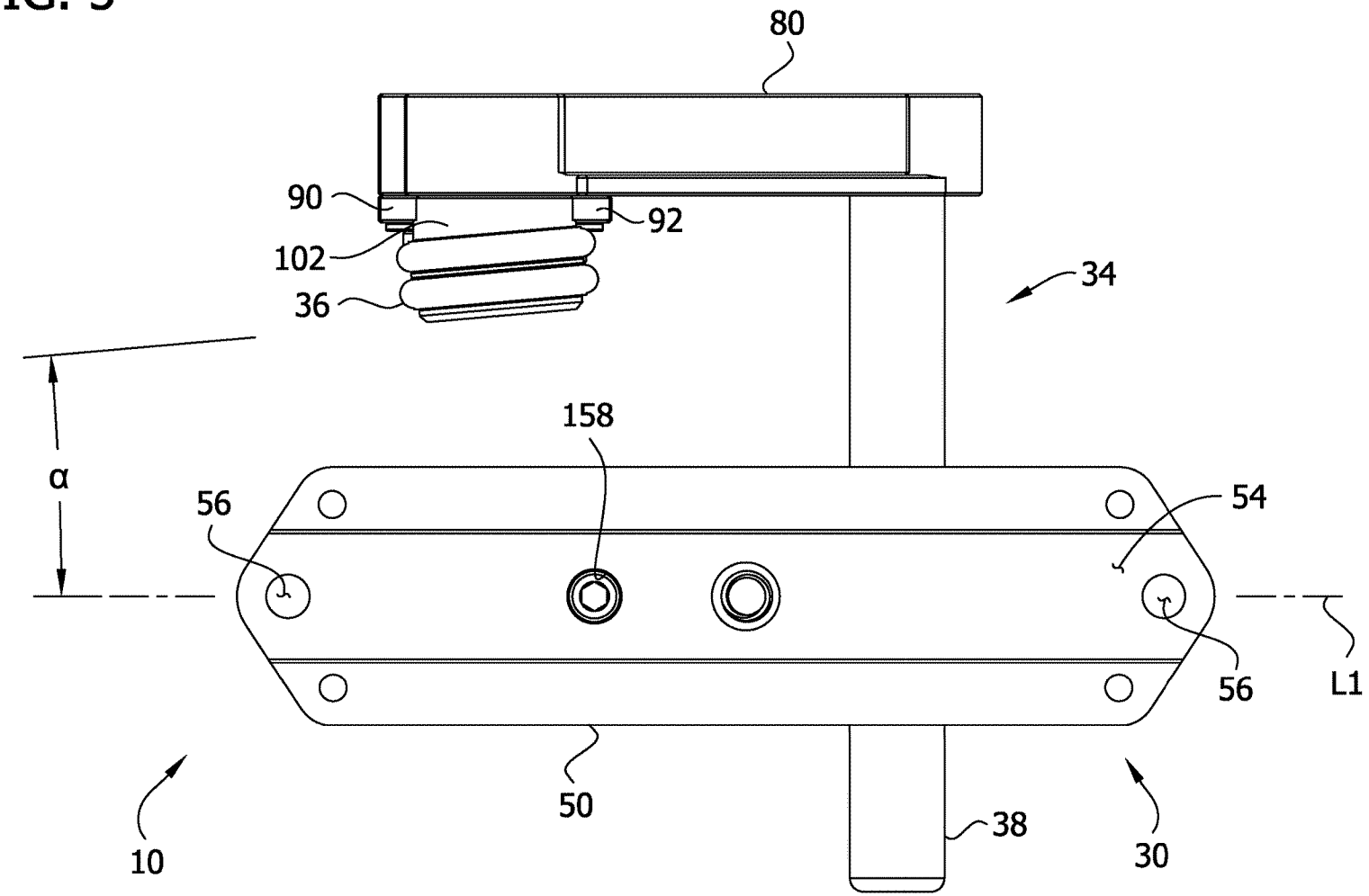
FIG. 5 is a bottom plan view of the stock guide assembly thereof.

As illustrated in FIGS. 7-10, the base 30 of the stock guide assembly 10 is configured for slidably mounting on the work table 12 for selectively positioning the stock guide assembly along the work table. In the illustrated embodiment, the base 30 has a lower portion 50 configured to be mounted on the work table 12 and an upper portion 52 configured to receive the shaft 38. The lower portion 50 of the base 30 has a groove 54 and a pair of holes 56 that extend through the lower portion and open toward the groove. The groove 54 extends in a substantially straight line along a longitudinal groove axis L1 (FIG. 5).

As shown in FIGS. 8-11, the base 30 is configured for slidably mounting on the work table 12 for adjusting the position of the stock guide assembly 10 along the work table with respect to the saw blade 18 and with respect to the infeed and outfeed ends 12A, 12B of the work table. In the illustrated embodiment, the groove 54 in the lower portion 50 of the base 30 is configured to slidably receive rails 58 that project upward from the work table 12. The rails 58 extend lengthwise between the infeed end 12A and the outfeed end 12B of the table saw 12 in the feed direction A. The rails 58 are part of a track 60 that is mounted on the fence 22. Though in the illustrated embodiment the track 60 is secured directly to the fence 22, the track can also be secured to another component, such as the work surface 16 of the work table 12, without departing from the scope of the invention.

Positioning bolts 62 extend through the holes 56 in the lower portion 50 of the base 30 and between the rails 58. A fixing strip 64 is slidably received between the rails 58 with threaded openings for each of the positioning bolts 62. In the illustrated embodiment, the fixing strip 64 is a one-piece body with separate, spaced apart threaded openings for each of the bolts 62. Instead of the fixing strip 64, individual nuts can also be used for each of the positioning bolts 62. With the fixing strip 64 slidably received in the track 60, the positioning bolts 62 threadably received in the fixing strip (but not fully tightened), and the rails 58 slidably received in the mounting groove 54, the stock guide assembly 10 can slide between the infeed end 12A and the outfeed end 12B of the work table 12. When the base 30 is mounted on the work table 12, the positioning bolts 62 can be tightened into threaded openings of the fixing strip 64 to fix the stock guide assembly in a desired position along the track 60. It should be understood that a stock guide assembly can be mounted on a work table and selectively positioned along the work table in other ways without departing from the scope of the invention.

Figure 2:
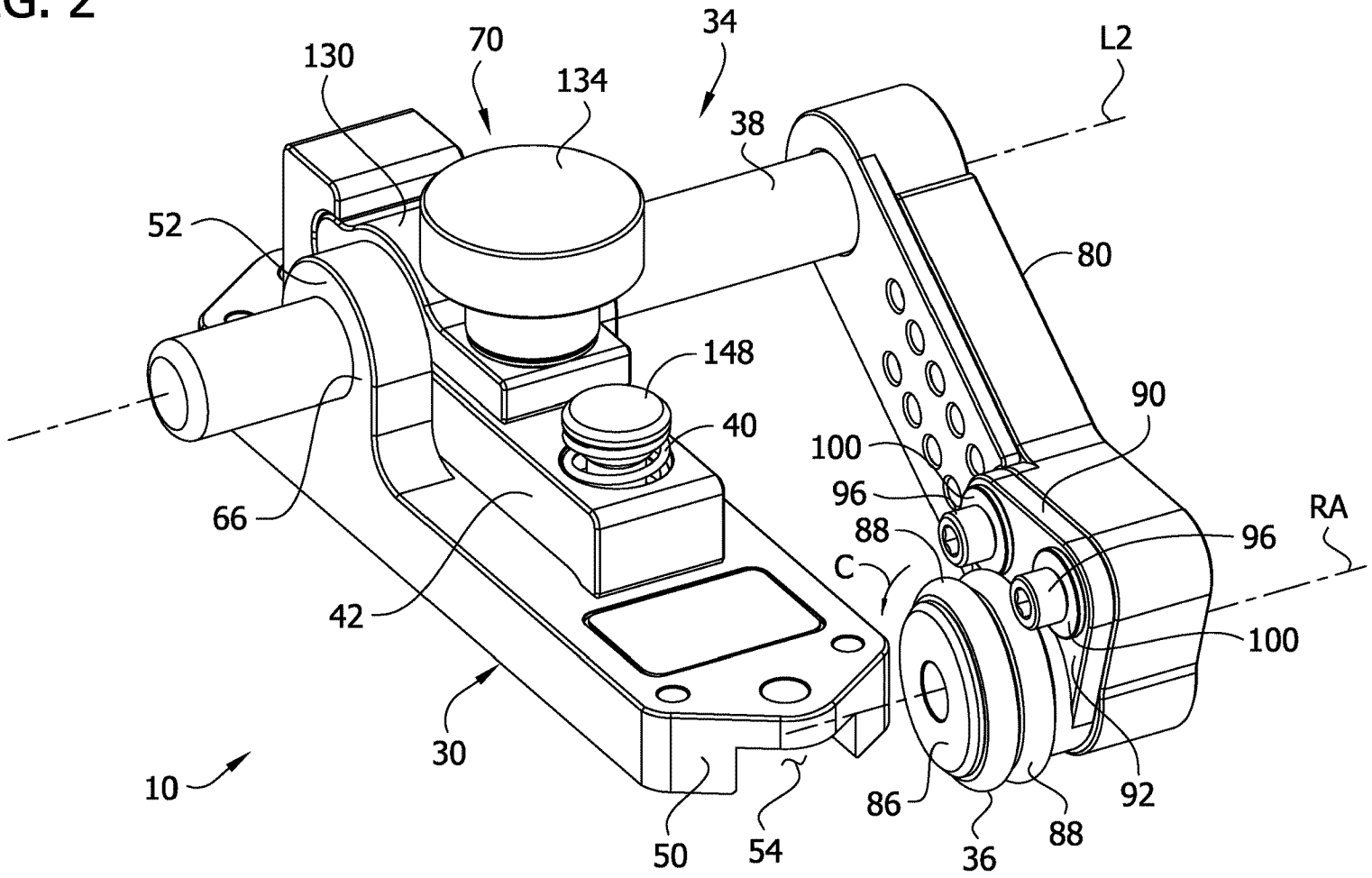
FIG. 2 is an enlarged perspective of one of the stock guide assemblies.
Figure 2A:
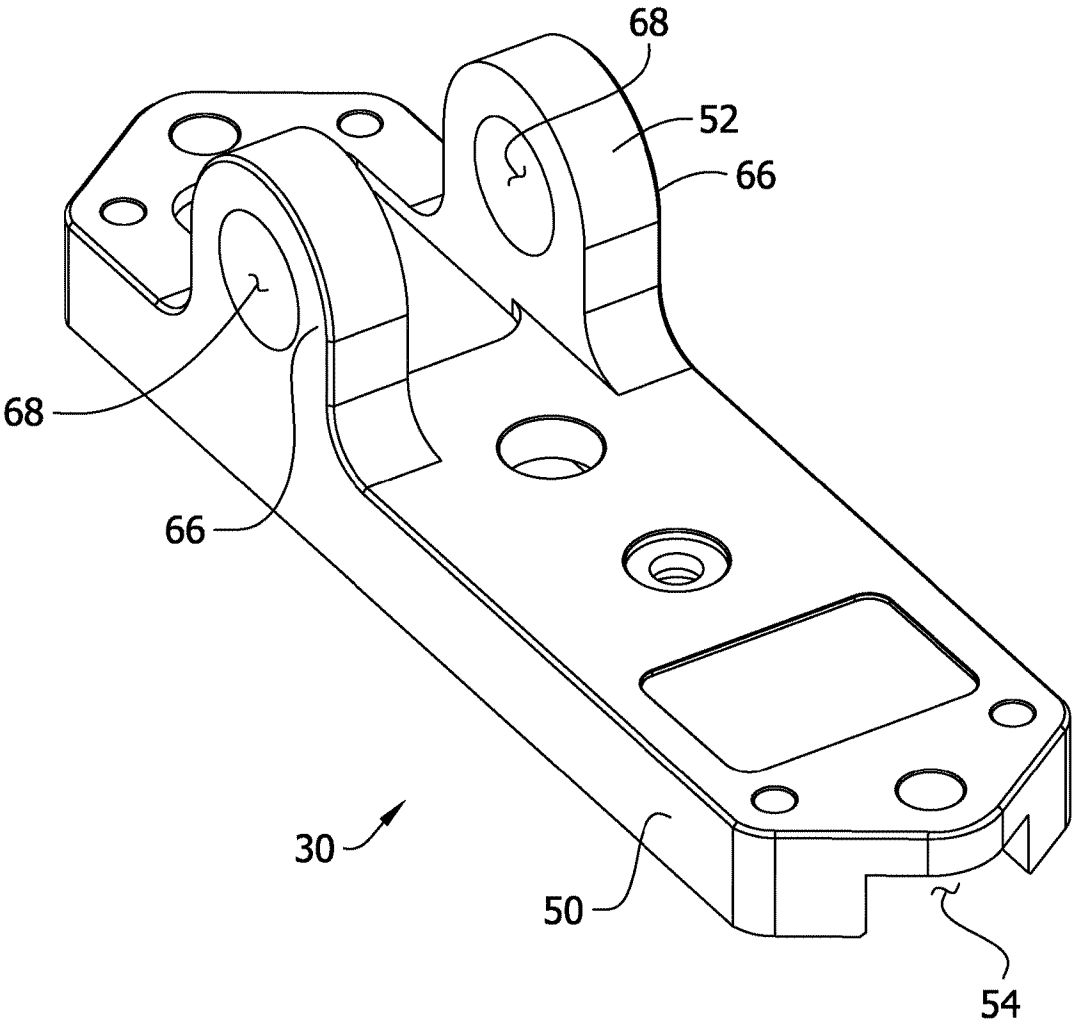
FIG. 2A is a perspective of a base of the stock guide assembly of FIG. 2.

Referring to FIGS. 2 and 2A, the upper portion 52 of the base 30 includes a pair of connector bearings 66. Each of the connector bearings 66 has a hole 68 configured to receive an end portion of the shaft 38 of the connector assembly 34. In the illustrated embodiment, the connector bearings 66 engage the shaft 38 to permit the shaft to both rotate about and translate along its longitudinal axis L2. The connector bearings 66 are parallel projections that extend up from the lower portion 50 of the base 30. Inboard surfaces of the connector bearings 66 and the lower portion 50 of the base 30 define a channel for receiving a locking device 70 that is configured to selectively engage the shaft 38 to prevent movement of the shaft relative to the base.

The roller arm 80 of the connector assembly 34 mounts the roller 36 for rotation about the roller axis RA with respect to the arm and the base 30. The arm 80 is pivotally connected to the base 30. In the illustrated embodiment, the arm 80 is secured to a free end of the shaft 38. When the base 30 is mounted on the work table 12 by the fence 22 (FIG. 8), the spring 40 biases the arm 80 to pivot toward the work surface 16. In the illustrated embodiment, the spring 40 biases the roller arm 80 about the longitudinal axis L2 of the shaft 38 in the biasing direction B, thereby biasing the roller 36 against the stock S.

Figure 12:
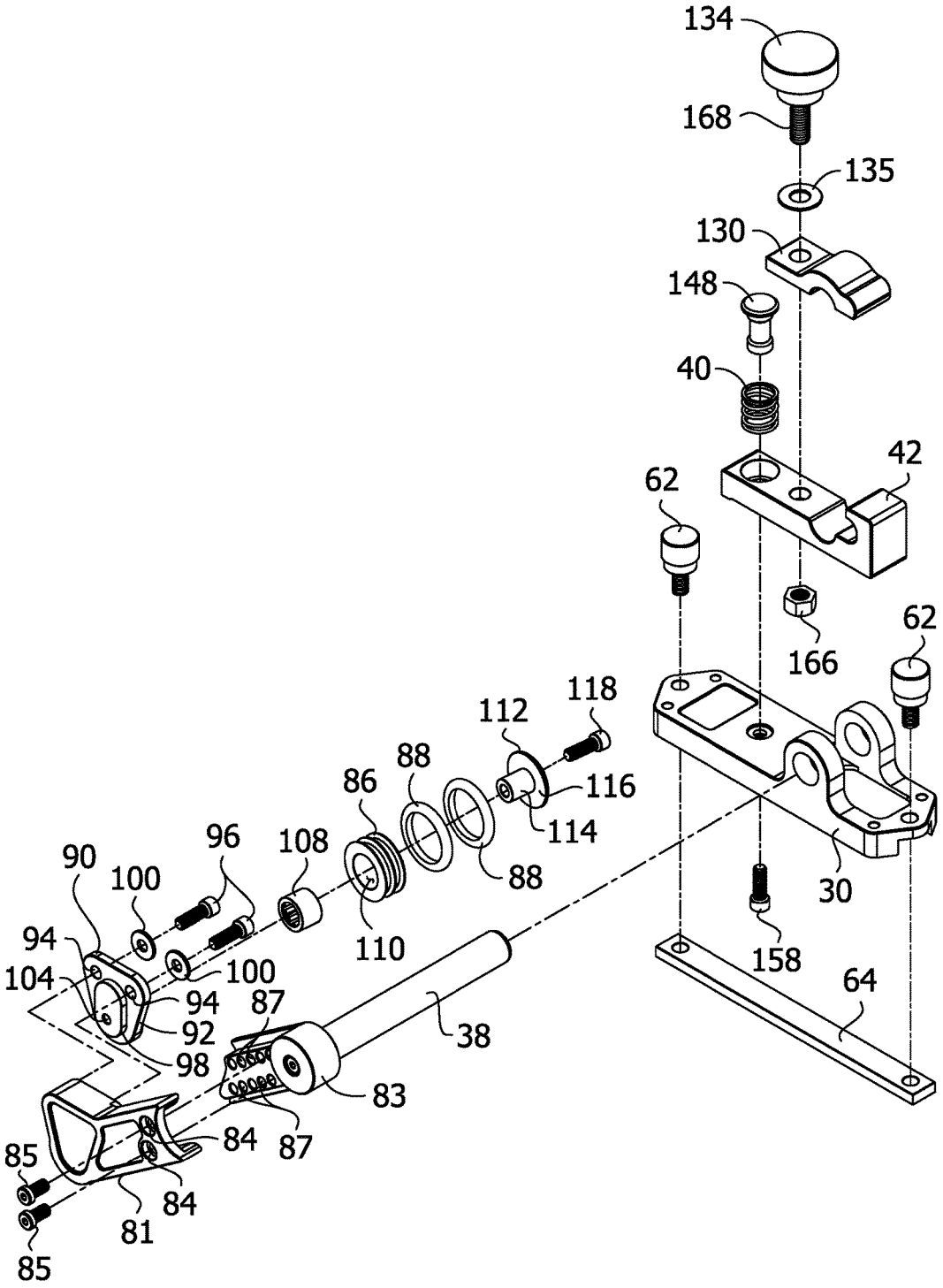
FIG. 12 is an exploded perspective of one of the stock guide assemblies.

Referring to FIG. 12, the length of the illustrated roller arm 80 is adjustable so that the stock guide assembly 10 accommodates stock S of different thicknesses and fences 22 of different heights. The roller arm 80 includes a first arm member 81 mountable on a second arm member 83 in a plurality of positions to adjust the length of the roller arm. The first arm member 81 includes a pair of mounting holes 84 for alignment with one of a set of pairs of threaded holes 87 in the second arm member 83. Bolts 85 extend through holes 84 in the first arm member 85 and tighten into one of the pairs of threaded holes 87 in the second arm member to mount the first arm member on the second arm member. The pair of threaded holes 87 which with the mounting holes 84 are aligned is chosen so that the roller arm 80 has the desired length (e.g., a length that, when the stock guide assembly 10 is mounted on the fence 22, accommodates the thickness of the stock S).

Figure 7:
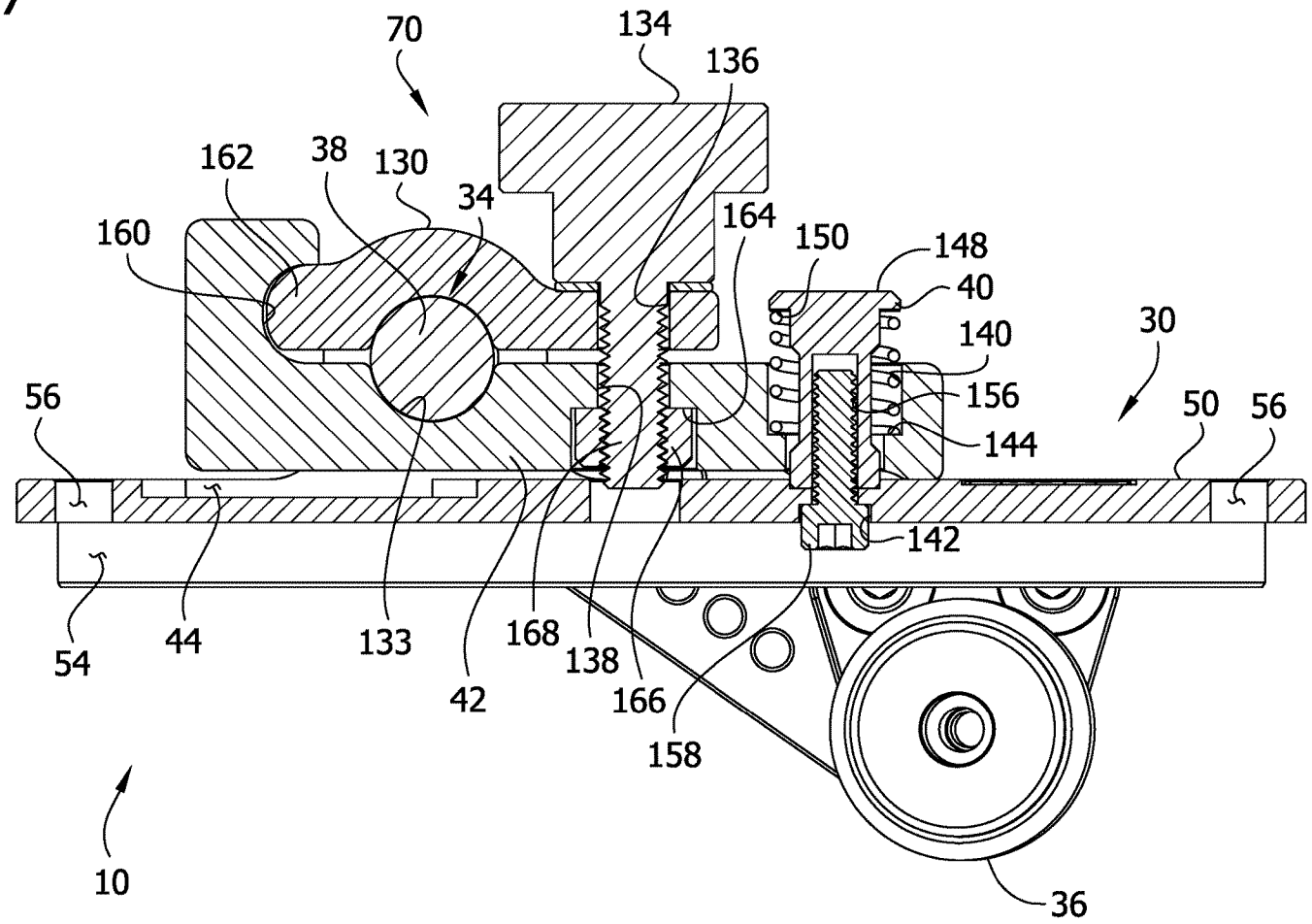
FIG. 7 is a section taken along line 7-7 of FIG. 3.

Referring to FIG. 7, the stock guide assembly 10 is configured so the roller 36 is movable in a direction opposite the biasing direction B against the force of the spring 40. In the illustrated embodiment, the stock guide assembly 10 includes a pivot bracket 42. The pivot bracket 42 is pivotally mounted to the base 30 and coupled to the roller 36 to pivot as the roller moves transversely with respect to the roller axis RA. The spring 40 is operatively connected to the base 30 and the pivot bracket 42 to bias the roller 36 in the biasing direction B toward the work surface 26 (FIG. 8). As shown in, for example, FIG. 7, the illustrated spring 40 is a compression spring that is operatively secured to the pivot bracket 42 and the base 30 to apply a spring force therebetween. The pivot bracket 42 is connected to the shaft 38 to pivot with the shaft 38 and arm 80 with respect to the base 30 in a clockwise direction as seen in FIG. 7. The spring 40 is connected between the base 30 and the pivot bracket 42 to pivotally bias the pivot bracket relative the base and thereby bias the arm 80 toward the work surface.

The illustrated pivot bracket 42 has a hole 140 near one end that is aligned with a corresponding mounting hole 142 in the base 30. The hole 140 is countersunk to have an annular shoulder 144 sized for engaging the spring 40. A spring holder 148 with a threaded opening 156 is received through the hole 140 and engages the base 30. A mounting bolt 158 extends up through the mounting hole 142 in the base 30 and is threadably received in the opening 156 in the spring holder 148 to secure the spring holder to the base. With the spring holder 148 fixed to the base 30, the spring 40 is constrained between an annular flange 150 of the spring holder and the annular shoulder 144 of the mounting hole 140 to bias a near end of the pivot bracket 42 toward contact with the base 30.

Another end of the pivot bracket is positioned above a depression 44 in the base 30. From the position illustrated in FIG. 7, the pivot bracket 42 is configured to pivot about the longitudinal axis L2 of the shaft 38 so that the end of the pivot bracket 42 rotates downward relative the base 30 into the depression 44. As the one end of the pivot bracket 42 rotates downward into the depression 44, the opposite end rotates upward away from the base 30 against the force of the spring 40. The pivot bracket 42 is configured to be secured to the shaft 38. The shaft 38 and the arm 80 pivot conjointly with the bracket 42 about the longitudinal axis L2 (FIG. 2). When the stock guide assembly 10 is secured to the work table 12 in an operative position (FIG. 8), an increase in the thickness of the stock S as it is fed in the feed direction A causes the arm 80 to pivot about the longitudinal axis L2 of the shaft 38 opposite the biasing direction B. This causes the pivot bracket 42 to pivot simultaneously about the longitudinal axis L2 of the shaft 38 against the force of the spring 40. The spring 40 biases the pivot bracket 42, shaft 38, and arm 80 in the biasing direction B about the longitudinal axis L2 of the shaft to urge the roller 36 to remain in contact with the stock S.

The illustrated embodiment provides but one example of a suitable biasing member in the form of the spring 40. It is contemplated that other biasing members can be operatively connected to a base and roller for yieldably biasing the roller relative the base so that transverse movement of the roller is biased in a direction toward a work surface when the base is mounted on a work table in other ways without departing from the scope of the invention. For example, it is contemplated that a roller arm can be pivotally connected to a connector shaft and a biasing member (e.g., a torsion spring) can be connected between the roller arm and connector shaft to urge a roller toward a work surface. Likewise, it is contemplated that a connector assembly can include a track along which the roller can slide in translation toward and away from a work surface. A biasing member (e.g., a compression spring) can be configured to urge the roller to slide in the track toward the work surface. Still other biasing members and arrangements can also be used without departing from the scope of the invention.

Figure 3:
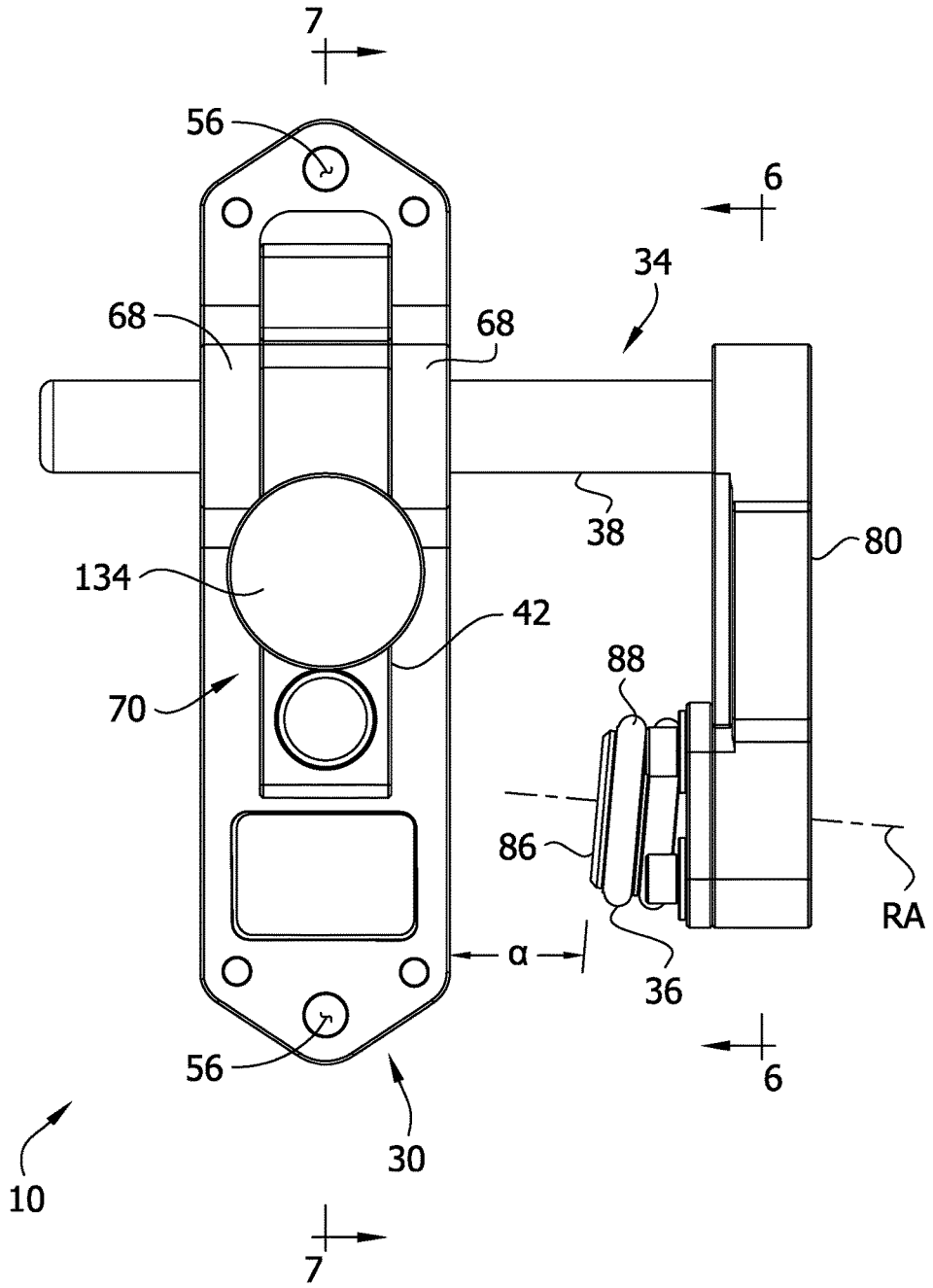
FIG. 3 is a top plan view of the stock guide assembly of FIG. 2.
Figure 4:
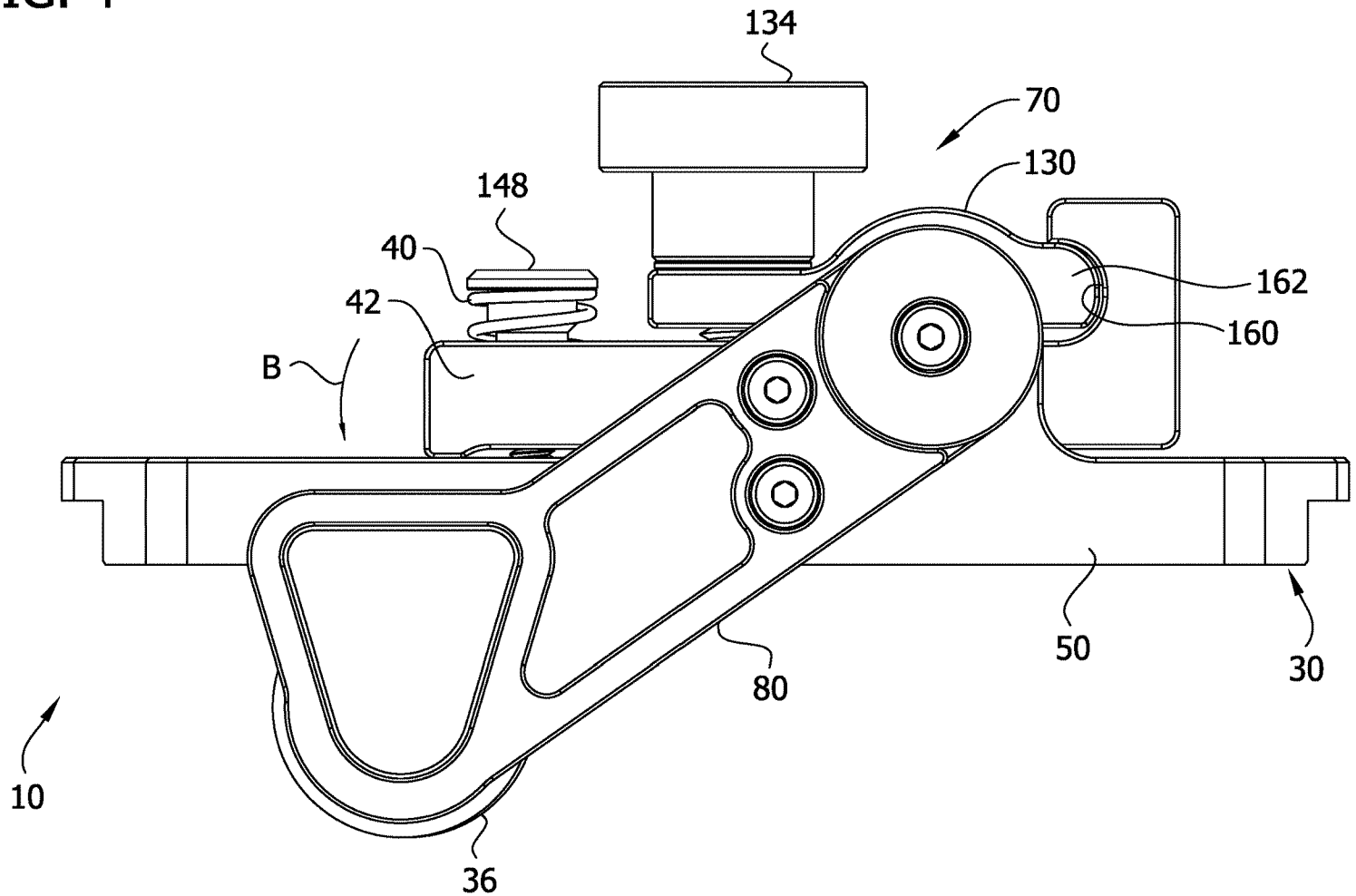
FIG. 4 is a right side elevation of the stock guide assembly thereof.
Figure 11:
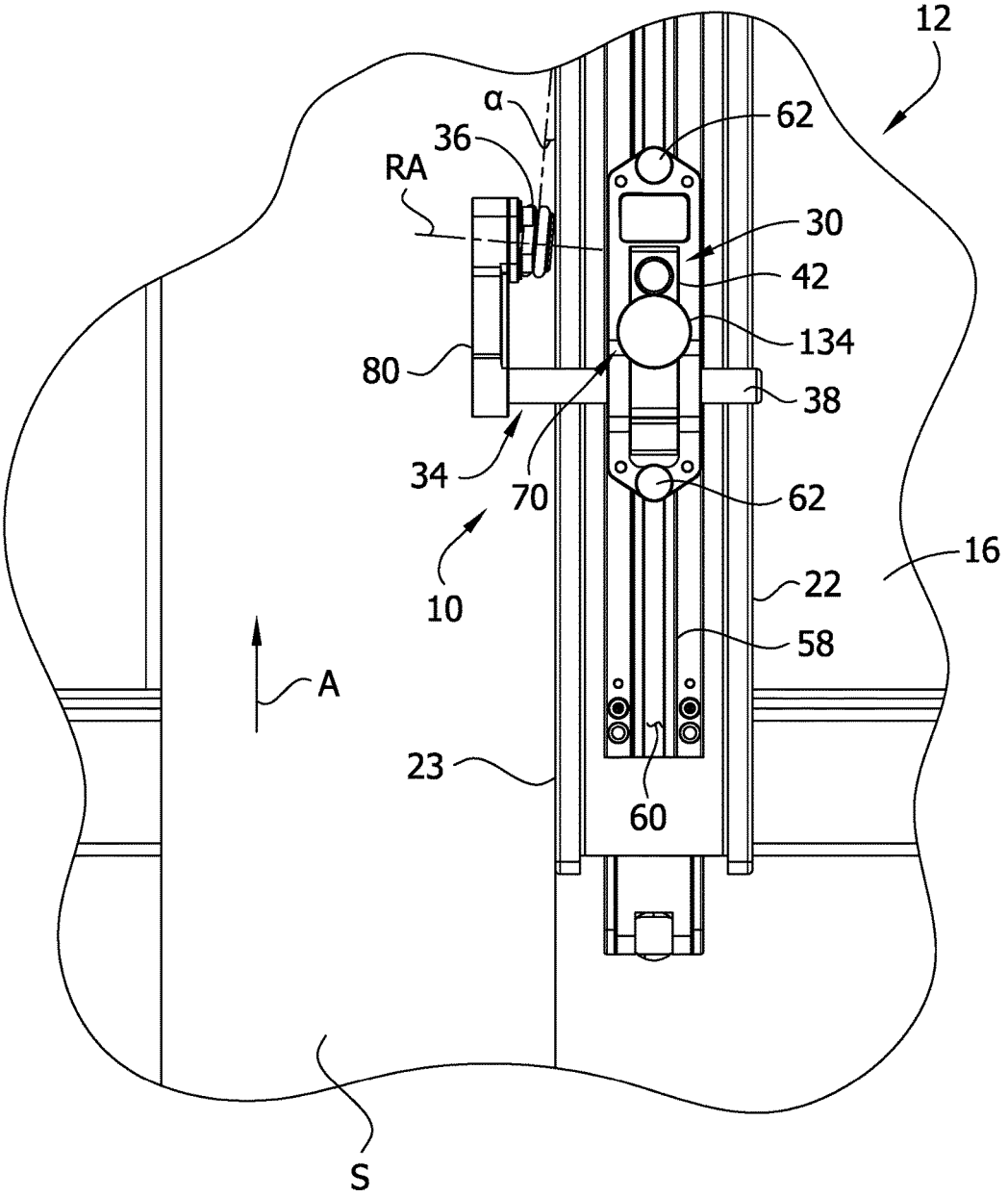
FIG. 11 is a fragmentary top plan view of the work table of FIG. 1, showing one of the stock guide assemblies.

As shown in FIG. 11, the roller axis RA is oriented at a transverse, non-perpendicular angle relative the feed. As shown in FIG. 3, the roller 36 is operatively connected to the base 30 at a skew angle $\alpha$ relative to the base to pull the stock S toward the fence 22 as the stock is fed in the feed direction A past the saw blade 18. However, it should be understood that other configurations (e.g., where the roller is connected to the base in parallel with the base) can also be used without departing from the scope of the invention. With the roller 36 oriented at the skew angle $\alpha$ relative the base, the roller axis is oriented at a transverse, non-perpendicular angle relative the feed direction. As shown in FIG. 5, the roller 36 is oriented with respect to the base 30 at the skew angle $\alpha$ relative to the longitudinal axis L1 of the mounting groove 54. When the base 30 is mounted to the work table 12, the roller 36 connects to the base at the skew angle $\alpha$ relative to the rails 58. Likewise, as shown in FIG. 11, when the base 30 is mounted on the work table 12, the roller 36 rotates in a plane (not shown) that is perpendicular to the roller axis RA and that forms a skew angle $\alpha$ relative to the plane of the planar side 23 of the fence 22. The roller 36 is angled relative the feed direction A to pull the stock S toward the fence 22 as the stock is fed in the feed direction past the saw blade 18. In the illustrated embodiment, the skew angle $\alpha$ is less than 90 degrees. The skew angle $\alpha$ is preferably within the range of about 3 degrees to about 10 degrees. In one embodiment, the skew angle $\alpha$ is about 5 degrees.

As shown in FIG. 2, the roller 36 has a roller hub 86 and a pair of O-rings 88 disposed on the roller hub. The O-rings 88 reduce markings on the stock S when the stock guide assembly 10 comes in contact with the stock while also gripping the stock to resist lateral movement. Each O-ring 88 can be any suitable size, such as 3/16 inch O-rings. As seen in FIG. 12, the roller hub 86 is generally cylindrical. The roller hub 86 has one channel for each O-ring 88. An opening 110 extends through the roller hub 86 for mounting the roller 36 on an axle 112 for rotation of the roller relative to the base 30.

Figure 6:
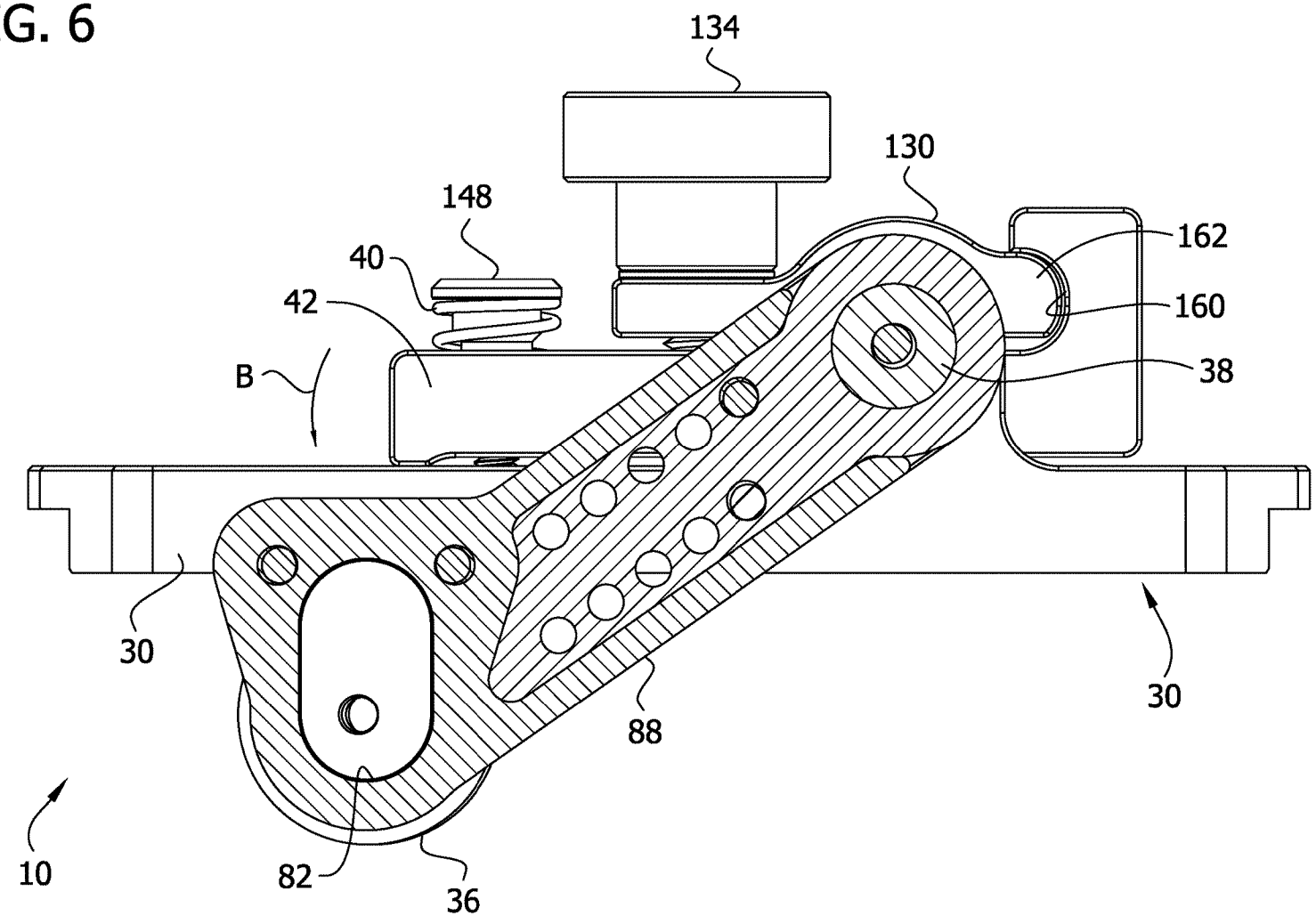
FIG. 6 is section taken along line 6-6 of FIG. 3.

Referring to FIG. 12, the roller 36 is mounted on a roller mount 90 that is attached to the roller arm 80. The roller mount 90 includes a base 92 with two openings 94 for receiving two fasteners 96 therethrough. The roller mount 90 also has a projection 98 that is received in a cavity 82 in the arm 80 (FIG. 6). The fasteners 96 attach the roller mount 90 to the arm 80 of the stock guide assembly 10 by extending through the base 92 and being threadably received in corresponding openings in the arm (not shown). Washers 100 are disposed between each fastener 96 and the roller mount 90. A mounting face 102 (FIG. 5) extends outward from the base 92 and includes a hole 104 (FIG. 12) extending therethrough. The mounting face 102 extends at an angle to the base 92. The angle between the mounting face 102 and the base 92 is equal to the skew angle $\alpha$ in the illustrated embodiment. However, other configurations are within the scope of the present invention. In the illustrated embodiment, engagement with the angled mounting face 102 angles the roller 36 relative to the arm 80 (see FIG. 5). Other configurations for attaching the roller 36 at an angle to the arm 80 are within the scope of the present invention.

The roller 36 is positioned against the mounting face 102. As shown in FIG. 12, a one-way bearing 108 is positioned in the opening 110 of the roller hub 86. An axle 112 extends through the one-way bearing 108 and through the roller 36 to engage the roller mount 90. The axle 112 includes a shaft 114 around which the roller 36 rotates and a flange 116 that retains the roller on the roller mount 90. A fastener 118 extends through the axle 112, the one-way bearing 108, and the roller hub 86 and attaches the roller hub to the roller mount 90 in the threaded opening 104. The one-way bearing 108 permits rotation of the roller 36 in one direction (i.e., the direction indicated by arrow C (FIG. 2)) and prevents rotation of the roller in the opposite direction. This unidirectional rotation of the roller 36 permits feeding of the stock S along the table 16 in only one direction, the feed direction A. Thus, the roller 36 resists kick back of the stock S (e.g., in a direction opposite to the feed direction A). It will be understood that the illustrated embodiment provides but one example of a roller 36 and that various alterations can be made without departing from the scope of the invention. For example, it is understood that the one-way bearing can be omitted within the scope of the present invention.

Referring to FIG. 8, when the base 30 of the stock guide assembly 10 is secured to the work table 12, the roller 36 is configured to engage the stock S so that movement of the stock in a direction opposite the feed direction A (i.e., a kickback direction) drives the roller 36 toward the stock to oppose the movement of the stock in the kickback direction. When the roller 36 engages the stock, the roller arm 80 is oriented relative the stock S so that movement of the stock in the kickback direction urges the roller arm to pivot in a direction that drives the roller toward the stock. In the illustrated embodiment the roller 36 is mounted on the end of the roller arm 80. The roller arm 80 is oriented at an angle $\gamma$ relative the work surface 16 and stock S. Movement of the stock in the kickback direction is opposed by the roller 36 and the one way roller bearing 108. The one way roller bearing 108 prevents the roller 36 from rolling along the surface of the stock S as it moves in the kickback direction. Instead, the roller 36 engages the stock S so that the stock applies a force in the kickback direction against the roller arm 80 at a location where the roller 36 contacts the stock. The force in the kickback direction drives the roller arm 80 to pivot about the longitudinal axis L2 of the shaft 38 in a direction that drives the roller 36 toward the work surface 16.

Figure 9:
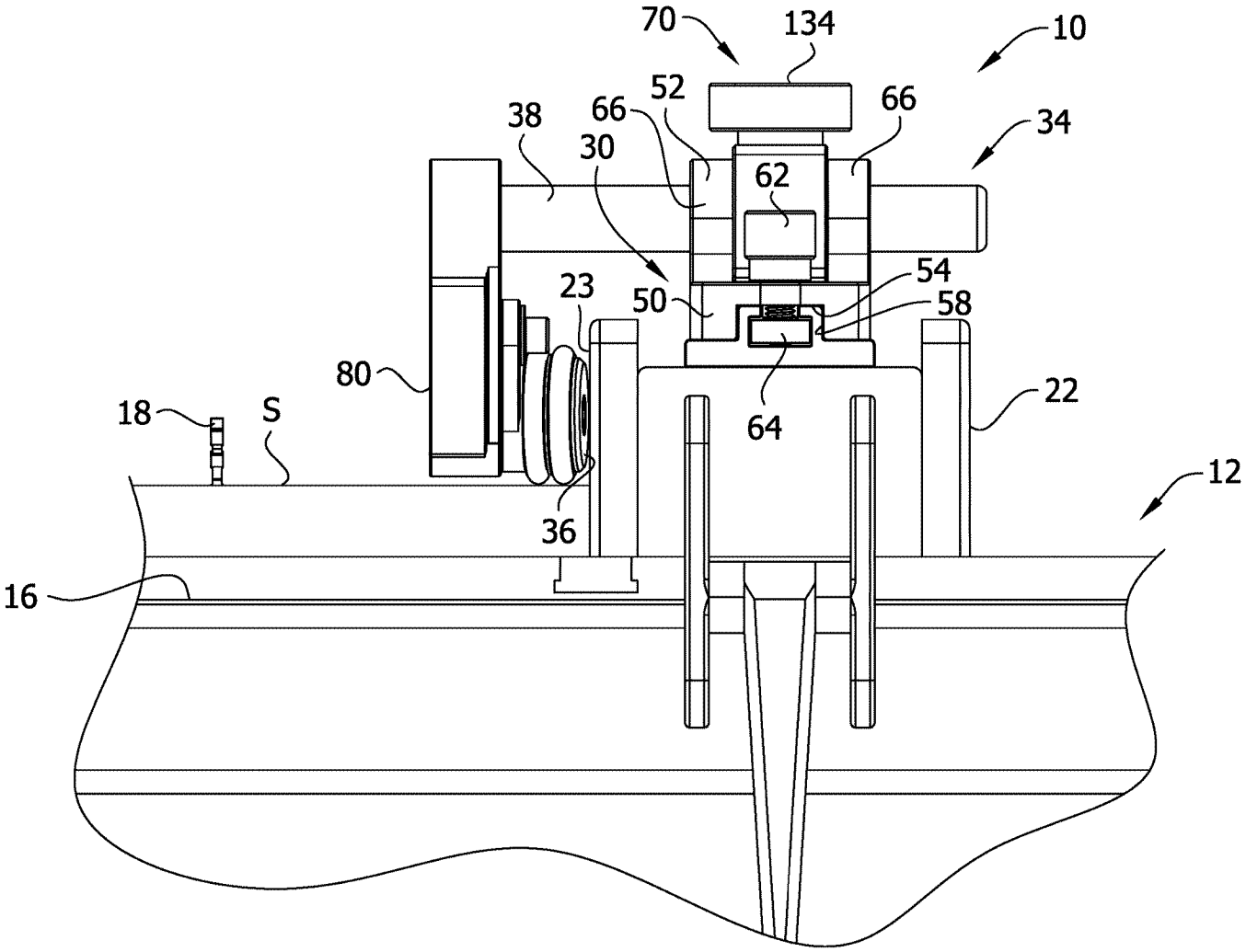
FIG. 9 is a fragmentary front elevation of the stock guide assemblies attached to the work table of FIG. 1.
Figure 10:
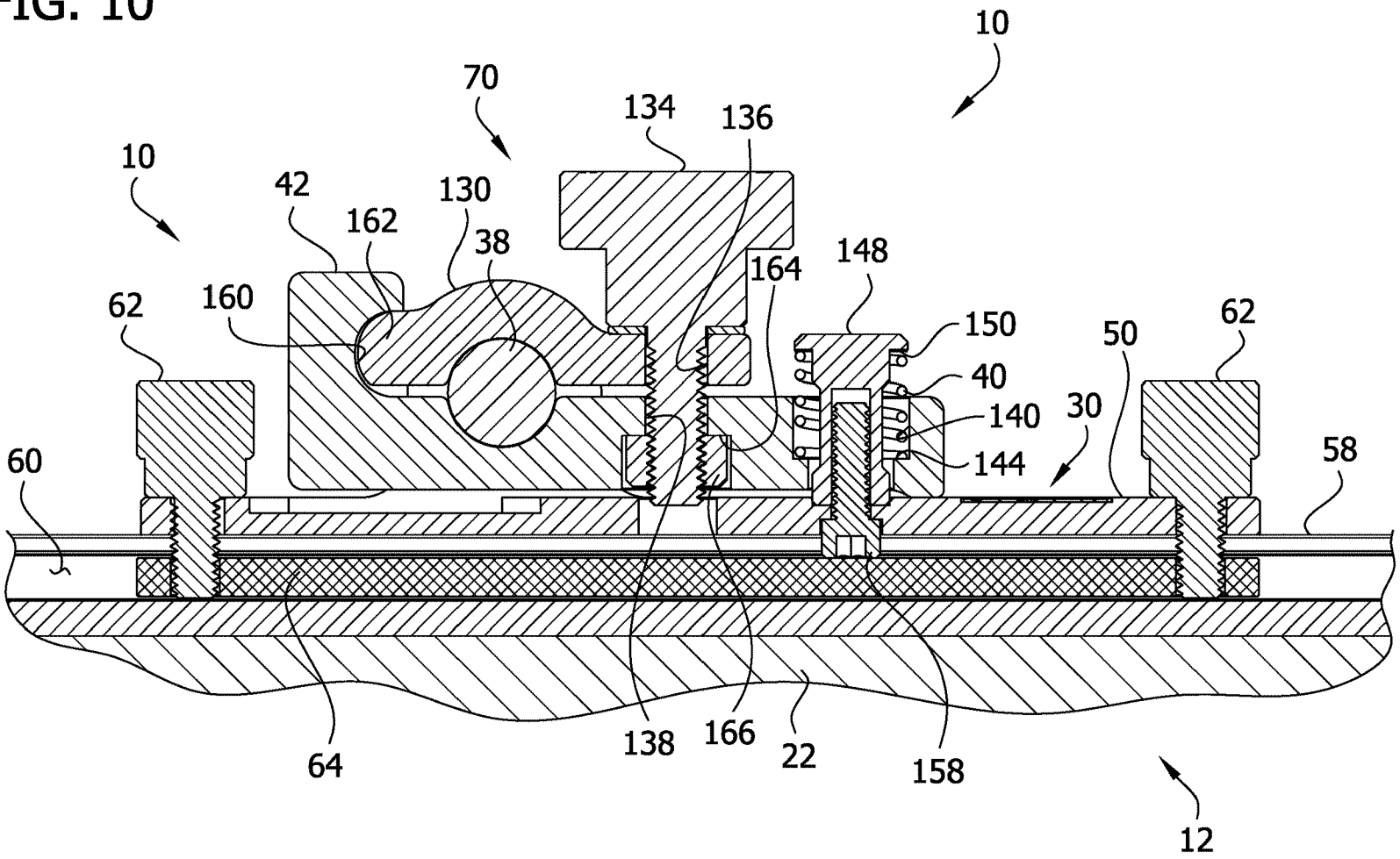
FIG. 10 is an enlarged fragment of a section taken along line 10-10 of FIG. 1.

Referring to FIGS. 8-9, the shaft 38 is movable with respect to the base 30 for adjusting the distance of the roller 36 from the base. When the base 30 is secured to the fence 22, the adjustment of the distance of the roller 36 from the base also adjusts the distance between the roller and the fence. By extending the distance between the roller 36 and base 30, the stock guide assembly can be arranged to contact the stock S at a greater distance from the fence 22. This can be useful, for example, for guiding wide stock with the stock guide assembly 10. In addition, this can be useful, for example, when the fence 22 is arranged relatively close to the saw blade 18 because the roller 36 can be configured to contact the stock S outside the saw blade with respect to the fence.

In addition to being connected to the base for selective translational adjustment along the longitudinal axis L2, the shaft 38 is connected to the base 30 for selective pivoting adjustment about the longitudinal axis of the shaft. In the illustrated embodiment, the shaft 38 is connected to the base 30 and projects outwardly therefrom. The shaft 38 extends through the holes 68 in the connector bearings 66 and is received in the locking device 70. When the locking device 70 is disengaged, the shaft 38 can translate along its longitudinal axis L2 in the holes 68 in the connector bearings 66. In addition, the shaft 38 can pivot about its longitudinal axis L2 free from the biasing force of the spring 40. When the locking device 70 is engaged, translation of the shaft is substantially inhibited and the distance of the roller 36 from the base 30 is fixed. In addition, engagement of the locking device 70 inhibits pivoting motion of the shaft 38 relative the pivot bracket 42. Thus, the shaft 38 cannot pivot in a biasing direction B relative the base 30 past an angular position in which the leading end of the pivot bracket 42 engages the base 30 (FIG. 7) when the locking device 70 is engaged. In addition, when the locking device 70 is engaged, the shaft 38 can only pivot in a direction opposite the biasing direction B relative the base 30 against the biasing force of the spring 40.

Referring to FIG. 7, the illustrated locking device 70 includes an upper clamping jaw 130 and the pivot bracket 42 that, together, define a locking passage 133 disposed to receive the shaft 38 as it extends through the holes 68 in the connector bearings 66. The pivot bracket 42 has an arcuate recess 160 configured to hingedly receive an arcuate end 162 of the upper clamping jaw 130. The locking device 70 also includes a lock down screw 134 that is engageable with the upper clamping jaw 130 to urge the upper clamping jaw against the shaft 38 to fix the distance of the roller 36 from the base and inhibit pivoting motion of the shaft relative the pivot bracket 42 (and clamping jaw). The lock down screw 134 is engageable with the upper clamping jaw 130 and the pivot bracket 42 to apply a clamping force to the shaft 38. The lock down screw 134 extends through a hole 136 in the upper clamping jaw 130 and a hole 138 in the pivot bracket 42. The hole 138 in the pivot bracket 42 is counterbored to have an annular shoulder 164. A threaded nut 166 is received in the hole 138 in the pivot bracket 42 and engages the bracket within the hole so as to be held against rotation. A threaded shank 168 of the lock down screw 134 extends through a washer 135 (FIG. 12), the hole 136 in the upper clamping jaw 130, and the hole 138 in the pivot bracket 42 and is threadably received in the nut 166.

The locking device 70 is configured for engagement with the shaft 38 in a locked position by tightening the lock down screw 134 into the nut 166. When the lock down screw 134 is tightened into the nut 166, the upper clamping jaw 130 is driven toward the pivot bracket 42 to lockingly grip the shaft 38 in the locking passage 133. The arcuate end 162 of the upper clamping jaw 130 hingedly engages the arcuate recess 160 of the pivot bracket 42 to prevent the arcuate end of the upper clamping jaw from pulling up away from the pivot bracket when the lock down screw 134 is threaded into the nut 166. The illustrated embodiment depicts one suitable locking device 70 for selectively positioning the roller 36 with respect to the base 30 and securing the roller in the selected position. It will be understood that other locking devices can also be used without departing from the scope of the invention.

Referring to FIGS. 1 and 8-11, in one method of securing a stock guide assembly 10 to the work table 12 in a desired position, the track 60 is secured to the work table at a selected spaced apart distance from the saw blade 18 so as to extend lengthwise between the infeed end 12A and the outfeed end 12B of the table. The track 60 is preferably secured to the fence 22. This way the spacing of the rails 58 from the saw blade 18 changes with the spacing of the fence 22 from the saw blade 18. A user (e.g., a woodworker) places the fixing strip 64 in the track 60 between the rails 58 and positions the stock guide assembly 10 over the rails 58 so the mounting groove 54 receives the rails. After inserting the positioning bolts 62 through the mounting holes 56 in the lower portion 50 of the base 30, the user threads the bolts into the fixing strip 64. With the bolts 62 partially threaded into the fixing strip 64, the stock guide assembly 10 slides along the track 60 to a desired position between the infeed and outfeed ends 12A, 12B of the work table 12. These steps can be repeated for a second stock guide assembly 10 to mount the second stock guide assembly at a second desired position between the infeed and outfeed ends 12A and 12B of the work table 12. Preferably, the user positions the stock guide assemblies 10 so as not to interfere with the operation of the saw blade 18. Likewise, the user can position of the stock guide assemblies 10 to maximize the holding force of the rollers 36 to prevent the stock S from pulling away from the work surface 16 of the work table 12 or the planar surface 23 of the fence 22. With the base 30 of a stock guide assembly 10 mounted to the track 60 in the desired position, the user can adjust the position of the roller 36 relative to the base.

If the locking mechanism 70 locks the shaft 38 in place, the user loosens the clamp down screw 134 to disengage the locking mechanism. When the locking mechanism 70 is disengaged, the user can move the shaft 38 to translationally adjust the distance of the roller 36 from the base 30. The shaft 38 slides in the holes 68 of the connector bearings 66 to move the roller 36 closer to or further away from the base 30. In some instances, when the fence 22 is partially secured to the work table 12 at a relatively small spaced apart distance from the saw blade 18, the user translationally adjusts the position of the shaft 38 to space the roller 36 from the fence a greater distance than the saw blade. When the fence 22 is partially secured to the work table 12 at a relatively large spaced apart distance from the saw blade 18, the user translationally adjusts the position of the shaft 38 to space the roller 36 from the fence 22 a lesser distance than the saw blade. When the positions of the saw blade 18 and the base 30 in the feed direction A are different, the user can translationally adjust the position of the shaft to space the roller 36 at any desired distance from the fence 22 (e.g., at the same distance from the fence as the saw blade, at a greater distance from the fence as the saw blade, or at a lesser distance from the fence than the saw blade).

The user can also adjust the position of the roller 36 relative the work surface 16 of the work table 12. With the locking device 70 in the unlocked position, the user can pivot the shaft 38 about its longitudinal axis in the bearings 66. As the shaft 38 pivots, the spacing between the work surface 16 and the roller 36 changes. Preferably, the user positions the roller 36 relative the work surface 16 at a position that accommodates the stock S. For example, the roller 36 can be positioned relative the work surface 16 so that the O-rings 88 engage the stock S when the stock is positioned on the work surface adjacent the planar surface 23 of the fence 22. It is contemplated that, in some instances, the user can position the roller relative the work surface 16 so that, when no stock is on the table, the roller is spaced apart from the work surface a dimension that is less than the thickness of the stock. Under these conditions, the roller 36 moves opposite the biasing direction B when the stock is loaded onto the work table 12 for cutting. As a result, the spring 40 applies a biasing force that drives the roller toward the stock S and helps hold it in place while permitting movement in the feed direction.

With the roller 36 in the desired position with respect to the base 30 and the work surface 12, the user locks the shaft 38 in place with the locking mechanism 70. The user tightens the clamp down screw 134 so that the upper clamping jaw 130 and the pivot bracket 42 lockingly grip the shaft 38. This fixes the rotational position of the shaft 38 with respect to the pivot bracket 42 and the translational position of the shaft with respect to the base 30.

As shown in FIG. 1, when one or more stock guide assemblies 10 are secured in the desired position, they can be used to guide feeding of the stock S past the saw blade 18. The roller 36 contacts the top surface of the stock S and exerts a downward force on the stock to counteract the stock's tendency to pull up from the work surface 16. The skew angle $\alpha$ of the roller 36 (FIG. 3) urges the stock S toward the fence 22 to counteract the stock's tendency to pull away from the fence. The roller 36, via the one way bearing 108, resists movement of the stock S in the kickback direction. The roller 36 resiliently moves to accommodate changes in the thickness of the stock S. In the illustrated embodiment, when an increase in stock thickness exerts an upward force on the roller 36, the roller arm 80, shaft 38, and pivot bracket 42 pivot together about the longitudinal axis of the shaft. As a result, an increase in stock thickness does not cause the partially secured fence 22 to lift away from the work surface 16 of the work table 12 when stock thickness increases. In addition, the spring 40 applies a biasing force on the pivot bracket 42 that urges the roller 36 toward the stock S to keep a firm engagement with the stock, even if the stock is thinner at another location.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A stock guide assembly for use with a work table to guide movement of stock along a work surface of the work table in a feed direction, the stock guide assembly comprising:

a base configured for mounting the stock guide assembly on the work table;

a shaft having a shaft axis and first and second end portions spaced apart along the shaft axis, the shaft mounted on the base for selectively moving along and pivoting about the shaft axis with respect to the base;

an arm having an arm axis oriented transverse to the shaft axis and first and second end portions spaced apart along the arm axis, the arm having a first arm member defining the first end portion and a second arm member defining the second end portion, the first and second arm members being selectively attachable to one another to selectively adjust a distance between the first and second end portions, the first end portion of the arm being attached to the second end portion of the shaft to constrain the arm for moving relative to the base conjointly with the shaft;

a roller mounted on the second end portion of the arm for rotation relative to the arm and for moving relative to the base conjointly with the arm and the shaft, the shaft being selectively movable relative to the base when the base is mounted on the work table to position the roller for engaging stock passing by the base to hold the stock against the work table;

a clamping assembly pivotably supported on the base for pivoting with respect to the base about the shaft axis in first and second pivot directions within a range of motion having a first end position and a second end position, the clamping assembly configured to be selectively connected to the shaft to inhibit movement of the shaft with respect to the base along the shaft axis and to constrain the shaft to pivot with the clamping assembly about the shaft axis with respect to the base within the range of motion, the clamping assembly comprising:

a pivot bracket having a first end portion and a second end portion and arranged relative to the base so that the first end portion engages the base when the clamping assembly is positioned at the first end position to inhibit movement of the clamping assembly from the first end position in the first pivot direction and so that the second end portion engages the base when the clamping assembly is positioned at the second end position to inhibit movement of the clamping assembly from the second end position in the second pivot direction; and a clamping jaw connected to the pivot bracket for selectively gripping the shaft between the pivot bracket and the clamping jaw to connect the shaft to the clamping assembly; and a biasing assembly operatively connected between the base and the clamping assembly to yieldably bias the clamping assembly relative to the base in the first pivot direction, the biasing assembly comprising:

a spring holder attached to the base; and a spring operatively connected to the spring holder and the pivot bracket to yieldably bias the pivot bracket in the first pivot direction;

wherein when the shaft is connected to the clamping assembly and the base mounts the stock guide assembly on the work table, wherein the biasing of the pivot bracket in the first pivot direction biases the roller in the first pivot direction toward engagement with the stock passing by the base through the connection between the clamping assembly and the shaft, and wherein movement of the roller in a direction away from the work surface pivots the arm, the shaft, and the clamping assembly in the second pivot direction relative to the base and the spring holder against the yieldable biasing force imparted by the compression spring until the second end portion of the pivot bracket engages the base at the second end position of the range of motion of the clamping assembly to inhibit further movement of the roller away from the work surface.

2. A stock guide assembly as set forth in claim 1 wherein the base includes a stop arranged for engaging the second end portion of the pivot bracket in the second end position.

3. A stock guide assembly as set forth in claim 2 wherein the stop includes a depression defined by the base, the pivot bracket being arranged relative to the base so that the second end portion of the pivot bracket extends into the depression when the pivot bracket reaches the second end position.

4. A stock guide assembly as set forth in claim 1 wherein the spring comprises an axial spring oriented transverse to an axis extending between the first and second end portions of the pivot bracket.

5. A stock guide assembly as set forth in claim 4 wherein the spring is operatively connected to the pivot bracket adjacent the first end portion.

6. A stock guide assembly as set forth in claim 5 wherein the pivot bracket is configured to pivot relative to the base about the shaft axis, the shaft axis being spaced apart from the spring toward the second end portion of the pivot bracket.

7. A stock guide assembly as set forth in claim 4 wherein the spring holder holds the spring in operative engagement with the pivot bracket.

8. A stock guide assembly as set forth in claim 7 wherein the pivot bracket defines a hole and an annular shoulder extending circumferentially around the hole, the spring holder extending through the hole.

9. A stock guide assembly as set forth in claim 8 wherein the spring holder comprises an annular flange spaced apart in opposing relationship with the annular shoulder of the pivot bracket.

10. A stock guide assembly as set forth in claim 9 wherein the spring comprises compression spring having a first end engaging the annular shoulder of the pivot bracket and a second end engaging the annular flange of the spring holder.

11. A stock guide assembly as set forth in claim 1 wherein the pivot bracket defines a depression for receiving a portion of the shaft.

12. A stock guide assembly as set forth in claim 1 wherein the clamping jaw comprises an end portion and the pivot bracket defines a recess hingedly receiving the end portion of the clamping jaw.

13. A stock guide assembly as set forth in claim 1 further comprising a lock down screw connected to the pivot bracket and the clamping jaw to urge the clamping jaw against the shaft and thereby grip the shaft between the pivot bracket and the clamping jaw.

14. A stock guide assembly as set forth in claim 1 wherein shaft is selectively moveable relative to the base along the shaft axis to adjust a distance between the roller and the base.

15. A stock guide assembly as set forth in claim 1 wherein the shaft is selectively rotatable about the shaft axis relative to the base to adjust a distance between the roller and the work surface.

16. A stock guide assembly as set forth in claim 1 wherein the roller is mounted on the second end portion of the arm at a skew angle for rotation relative to the base about a roller axis oriented at a transverse, non-perpendicular angle relative the feed direction.

* * * * *